US007753113B1

(12) United States Patent
Penisson

(10) Patent No.: US 7,753,113 B1
(45) Date of Patent: Jul. 13, 2010

(54) MODULAR JUNK BASKET DEVICE WITH BAFFLE DEFLECTOR

(76) Inventor: Dennis J. Penisson, 2265 Highway 182, Raceland, LA (US) 70394

( * ) Notice: Subject to any disclaimer, the term of this patent is extended or adjusted under 35 U.S.C. 154(b) by 0 days.

(21) Appl. No.: 12/054,260

(22) Filed: Mar. 24, 2008

Related U.S. Application Data

(60) Provisional application No. 60/896,786, filed on Mar. 23, 2007.

(51) Int. Cl.
*E21B 31/08* (2006.01)

(52) U.S. Cl. ..... 166/99; 166/162

(58) Field of Classification Search ..... 166/99, 166/162, 242.6
See application file for complete search history.

(56) References Cited

U.S. PATENT DOCUMENTS 2,797,755 A * 7/1957 Bobo ..... 175/312
2,819,038 A * 1/1958 Eckel ..... 175/99
2,834,300 A 5/1958 Brock
2,894,725 A 7/1959 Baker
2,912,227 A * 11/1959 Baker ..... 175/312
2,993,539 A * 7/1961 Baker ..... 166/99
3,089,724 A 5/1963 Crooks
3,198,256 A * 8/1965 Kirby, II ..... 166/99
4,059,155 A 11/1977 Greer
4,111,262 A 9/1978 Duncan
4,217,966 A * 8/1980 Garrett ..... 175/308
6,176,311 B1 * 1/2001 Ryan ..... 166/99
6,951,251 B2 10/2005 Penisson
7,096,950 B2 * 8/2006 Howlett et al. ..... 166/298

* cited by examiner

*Primary Examiner*—Shane Bomar
(74) *Attorney, Agent, or Firm*—Carver, Darden, Koretzky, Tessier, Finn, Blossman & Areaux, LLC; Raymond G. Areaux; Lisa Velez

(57) ABSTRACT

A modular junk basket device adapted for use in a wellbore. The modular junk basket has a central mandrel. The device further comprises a removable junk basket operable to collect debris from the wellbore. The device also includes a removable baffle operable to deflect fluid and debris flowing around the junk basket. The central mandrel has a top end, a bottom end and a first mandrel coupler operable to removably couple the junk basket concentrically around the central mandrel a distance above the bottom end. The central mandrel also includes a second mandrel coupler operable to removably couple the baffle a predetermined distance above a top opening in the junk basket and below the top end.

18 Claims, 4 Drawing Sheets

MODULAR JUNK BASKET DEVICE WITH BAFFLE DEFLECTOR

CROSS-REFERENCE TO RELATED APPLICATIONS

The present application claims priority from U.S. Provisional Application No. 60/896,786, filed Mar. 23, 2007, which is incorporated herein by reference as if set forth in full below.

BACKGROUND OF THE INVENTION

I. Field

The present invention relates to an oilfield tool and more particularly, to a modular junk basket device with a removable baffle to deflect debris into a junk basket opening.

II. Background

Various types of junk baskets have been devised for collecting debris from a wellbore during a cleaning operation. The junk basket has a basket dimensioned to collect debris flowing around and external to the basket. The top end of the junk basket is open and relies on free falling debris in the upward-flowing drilling fluid to fall into the opening of the junk basket where it remains until the junk basket is removed. However, the force of the upward-flowing drilling fluid carrying the debris impedes the collection of the debris by the junk basket.

Thus, some junk baskets are not able to collect a substantial portion of the debris in the well, particularly when fluid circulates through the junk basket and upward through an annulus in the well as the basket is retrieved to the surface. Other junk baskets are complicated and are thus relatively expensive.

FIG. 1 illustrates a conventional junk basket 1 having a central mandrel 2 and a basket 4. The annulus between the wellbore 3 and the basket 4 narrows. Thus, the upward-flowing fluid, denoted by ARROW A, has a first speed. The fluid, denoted by ARROW B, has a second speed faster than the first speed as a result of the narrower annulus. The fluid, denoted by ARROW C, continues upward toward the top of the wellbore 3 and is generally slower than the fluid, denoted by ARROW B. However, as the fluid, denoted by ARROW B, passes the upper end of the basket 4, a portion of the fluid automatically travels, in the direction of ARROW E, toward the central mandrel 2 as the annulus is abruptly enlarged. This portion of the fluid flowing in the direction denoted by ARROW E forms small eddy currents created directly over the opening in the basket 4. However, simultaneously, fluid flowing upward, in the direction of ARROW C, recaptures or carries away the debris. Thus, the deposit of debris in the basket 4 is impeded.

Thus, there is a continuing need for a modular junk basket device that creates an obstruction a predetermined distance above an opening in the junk basket to deflect debris, traveling upward in the reverse flow of the drilling fluid, in an opposite direction to the flow of the drilling fluid and into the opening of the junk basket device for the deposit of debris.

SUMMARY OF THE INVENTION

The present invention contemplates a modular junk basket device adapted for use in a wellbore. The modular junk basket has a central mandrel. The device further comprises a removable junk basket operable to collect debris from the wellbore. The device also includes a removable baffle operable to deflect fluid and debris flowing around the junk basket. The central mandrel has a top end, a bottom end and a first mandrel coupler operable to removably couple the junk basket concentrically around the central mandrel a distance above the bottom end. The central mandrel also includes a second mandrel coupler operable to removably couple the baffle a predetermined distance above a top opening in the junk basket and below the top end.

The above and other objects and features of the present invention will become apparent from the drawings, the description given herein, and the appended claims.

BRIEF DESCRIPTION OF THE DRAWING

For a further understanding of the nature and objects of the present invention, reference should be had to the following description taken in conjunction with the accompanying drawings in which like parts are given like reference numerals.

Figure 1:
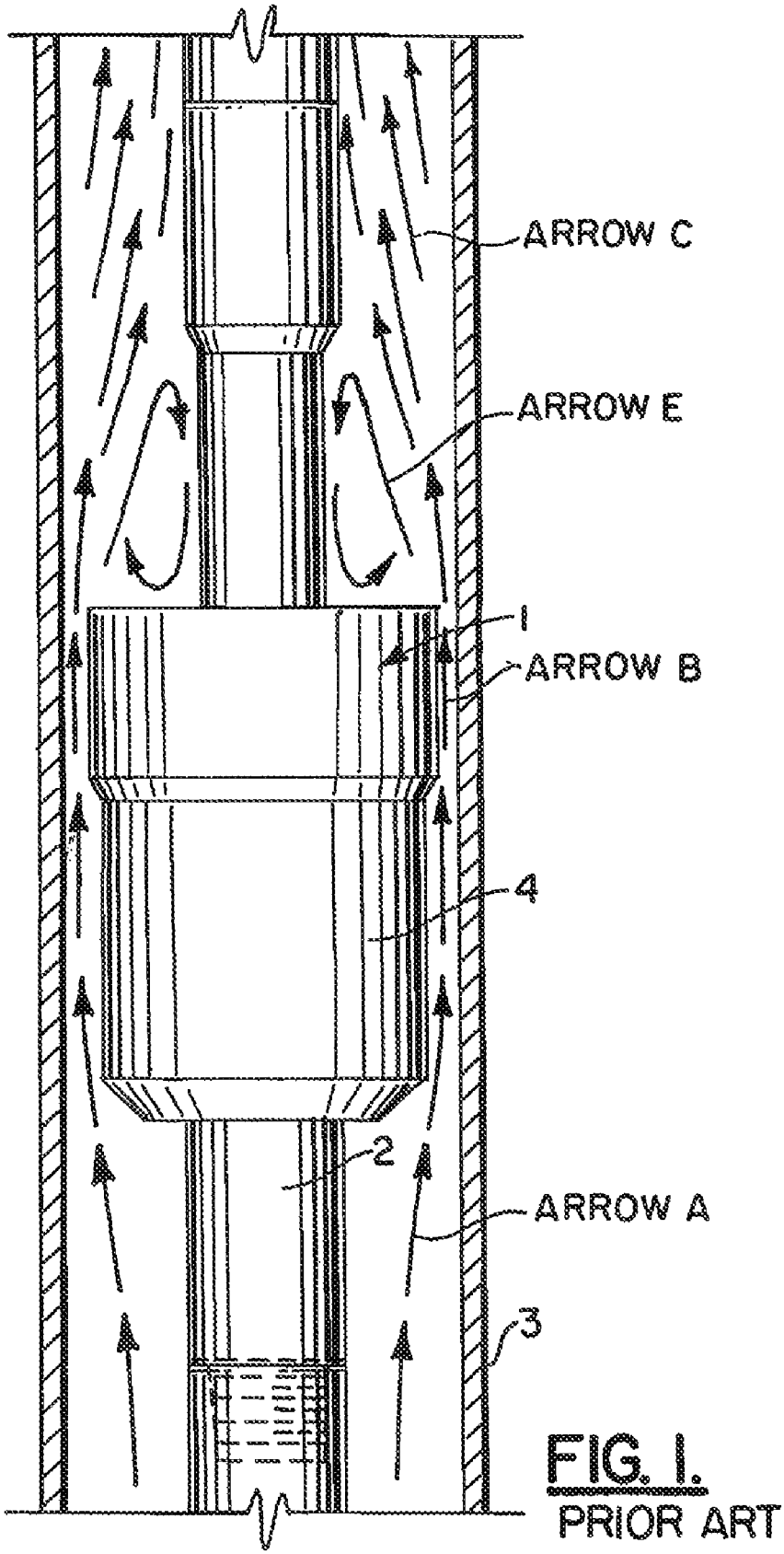
FIG. 1. PRIOR ART
FIG. 1 illustrates a conventional junk basket.

The images in the drawings are simplified for illustrative purposes and are not depicted to scale. To facilitate understanding, identical reference numerals have been used, where possible, to designate identical elements that are common to the Figures, except that suffixes may be added, when appropriate, to differentiate such elements.

The appended drawings illustrate exemplary configurations of the invention and, as such, should not be considered as limiting the scope of the invention that may admit to other equally effective configurations. It is contemplated that features of one configuration may be beneficially incorporated in other configurations without further recitation.

DETAILED DESCRIPTION

Referring now to the drawings and particularly FIGS. 2-5, a modular junk basket device is designated by the reference numeral 10. The modular junk basket device 10 is operable to be positioned in a wellbore 12, such as defined by the interior surface 14 of a casing string 16, to collect debris from a wellbore drilling or cleaning operation. The interior surface 14 may be in fluid communication with a hydrocarbon formation.

The modular junk basket device 10 generally comprises a central mandrel 18, a removable junk basket 40 and removable baffle 50. The central mandrel 18 includes an upper end 20 for connection with an upper tubing string X1, a throughbore 22, and an exit port 24 at a lower end 26 for passing fluids from the upper tubing string X1, downward through the throughbore 22, and exit port 24. The lower end 26 of the central mandrel 18 has coupled thereto a lower tubing string X2.

The central mandrel 18 is constructed and arranged as a single unitary structure. As the central mandrel 18 is torque bearing, the single unitary structure eliminates multiple parts which are subject to failure during operation. In one configuration, only the central mandrel 18 is made of high strength steel. The strength of the core mandrel 18 is necessary because it must hold the weight and torque of the string. The removable junk basket 40, removable baffle 50 and webs 60 must be strong but the material does not have to hold the weight of the string.

The baffle 50 is located a predetermined distance above an upper opening 41 into the junk basket 40 and below the upper end 20. The junk basket 40 is coupled a predetermined distance above the lower end 26. The junk basket 40 has a capacity of approximately 13½ gallons.

The upper end 20 of the central mandrel 18 may have a connector, such as a box type threaded connector 28, for connection to the upper tubing string X1. The central mandrel 18 further includes a first mandrel coupler 30 integrated into the body of the central mandrel 18 a predetermined distance above the lower end 26 for removably connecting the junk basket 40 to the central mandrel 18. The first mandrel coupler 30 mates with a basket coupler 42 of the junk basket 40. In one aspect, the first mandrel coupler 30 and the basket coupler 42 are coupled via a threaded connection. Immediately above the first mandrel coupler 30, the central mandrel 18 further includes a lower ledge or seat 32 located at the upper end of the first mandrel coupler 30. The lower ledge or seat 32 is created by an increase in the outer diameter OD of the central mandrel 18 about the first mandrel coupler 30. The basket coupler 42 includes an upper brim 42*a* and a lower threaded connection section 42*b* wherein the brim 42*a* rests upon the lower edge or seat 32 when the junk basket has been fully screwed into place. The lower edge or seat 32 would serve to limit the junk basket 40 from moving further down the central mandrel 18.

The junk basket device 10 further comprises one or more webs 60 positioned between the central mandrel 18 and the junk basket 40 for radially spacing and supporting the junk basket 40 with respect to the central mandrel 18. The central mandrel 18 further includes an upper seat 34. The upper seat 34 provides a seat for resting the one or more webs 60 thereon. The webs 60 have a plurality of spokes 64. In one aspect, there are two webs 60 which are coupled together via fasteners 62.

During installation of the removable junk basket 40, the central mandrel 18 would have no other structures, such as the baffle 50, coupled thereto. Thus, the central mandrel 18 is threaded through a center of the removable junk basket 40. The removable junk basket 40 is secured or tightened about the central mandrel 18 such as by turning or screwing the removable junk basket 40, via the threaded connection between the first mandrel coupler 30 and the basket coupler 42, until the upper brim 42*a* rests upon (in direct surface to surface contact with) the lower edge or seat 32. Thereafter, the webs 60 may be fastened about the OD of the central mandrel 18.

In one configuration, the webs 60 could be attached first to help align the threads of the basket coupler 42 with the bushing threads of the first mandrel coupler 30. The threads of the threaded connections may be left-handed or right-handed. However, in one configuration the threads are left-handed.

The central mandrel 18 further comprises a second mandrel coupler 36. Immediately above the second mandrel coupler 36, the central mandrel 18 further includes an upper baffle seat 38 located at the upper end of the second mandrel coupler 36. The upper baffle seat 38 is created by an increase in the outer diameter OD of the central mandrel 18 about the second mandrel coupler 36. The second mandrel coupler 36 mates with a baffle coupler 52 of the baffle 50. In one aspect, the second mandrel coupler 36 and the baffle coupler 52 are coupled via a threaded connection. The baffle coupler 52 includes an upper baffle brim 52*a* and a lower threaded connection section 52*b* wherein the upper baffle brim 52*a* rests upon the upper baffle seat 38. The upper baffle seat 38 would serve to limit the baffle 50 from moving further down the central mandrel 18.

In one aspect, the OD of the baffle 50 substantially tracks the diameter of the opening 41. Thus, the annulus between the OD of the baffle 50 and the interior surface 14 of the casing string 16 allows the fluid to travel and flow up and around the OD of the baffle 50. A top side of the baffle 50 has a sloped shoulder 56 to direct the fluid toward the central mandrel 18 as the annulus increases. The baffle 50 has a generally circular profile providing a 360° surface above the opening 41. Thus, the baffle 50 serves to deflect the fluid and debris 360° above the opening 41.

Figure 7:
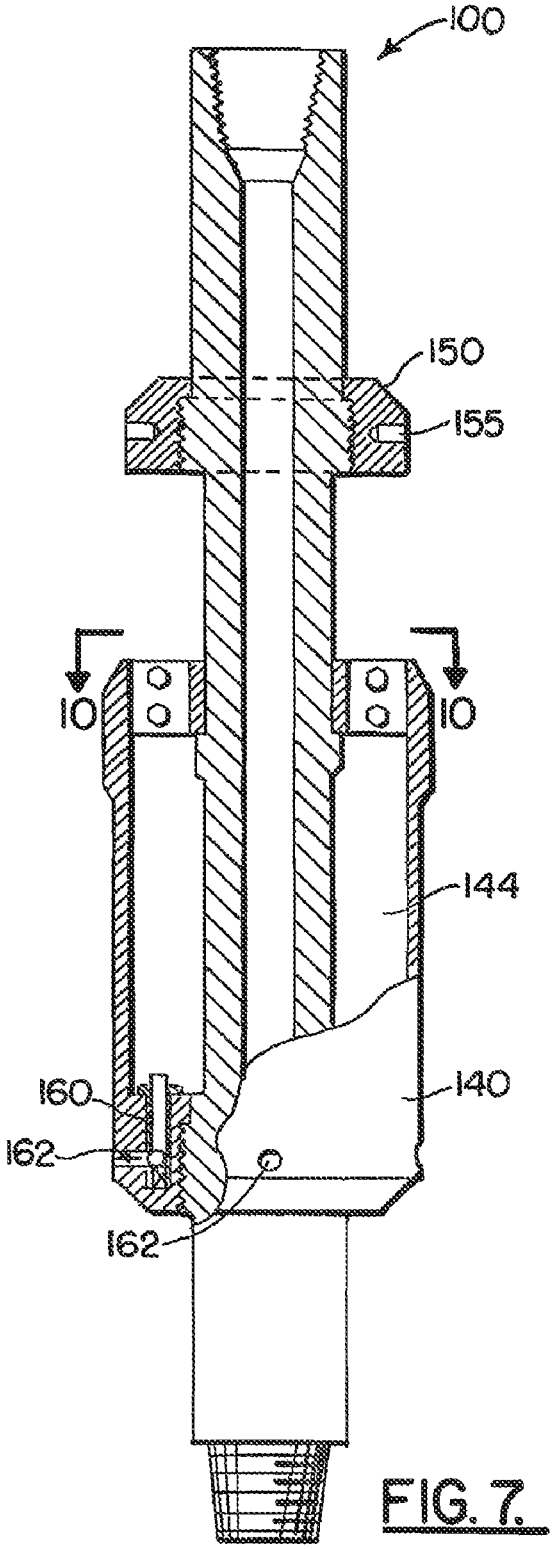
FIG. 7 illustrates an alternate configuration of the modular junk basket device with a portion of the junk basket and baffle removed.
Figure 6:
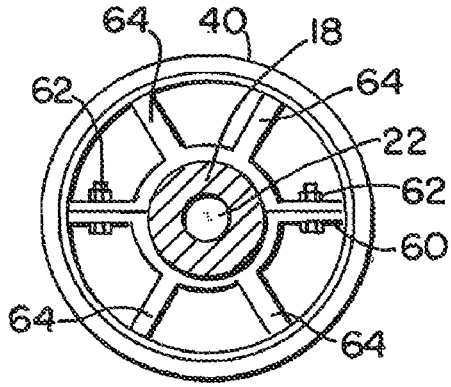
FIG. 6 illustrates a top end view along the plane 6-6 of FIG. 4.

During installation of the removable baffle 50, the central mandrel 18 is threaded through a center of the removable baffle 50. The removable baffle 50 is secured or tightened about the central mandrel 18 such as by turning or screwing the removable baffle 50, via the threaded connection between the second mandrel coupler 36 and the baffle coupler 52, until the brim 52*a* rests upon (in direct surface to surface contact with) the upper baffle seat 38. As best seen in FIG. 7, the baffle 150 may include slots 155 for attaching a tool (not shown) to the baffle 150 so that it can be turned, rotated and tightened about the central mandrel 18.

As can be readily seen, the threaded connections allow the junk basket 40 and the baffle 50 to be easily removed and replaced with other junk baskets and baffles of a different size depending on the casing size.

The junk basket 40 is an open and hollow cylindrically-shaped structure adapted to be coupled to the central mandrel 18. The junk basket 40 concentrically surrounds the central mandrel 18 to form a generally annular junk collecting space 44. The annular junk collecting space 44 is generally open at a top end 46 of the cylindrically-shaped structure. The first mandrel coupler 30 and the basket coupler 42 together substantially close the bottom of the annular junk collecting space 44 of the cylindrically-shaped structure. The cylindrically-shaped structure includes an upper portion 48*a* and a lower portion 48*b* integrally formed together to create a single unitary junk basket 40. The upper portion 48*a* has a larger outer diameter OD than the lower portion 48*b*. In one aspect, the inner diameter ID of the upper portion 48*a* and the lower portion 48*b* are substantially the same.

A reduced annulus 72 is defined within the wellbore 12 between the interior surface 14 of the casing string 16 and the lower portion 48*b* of the junk basket 40. A further reduced annulus 74 is created between the interior surface 14 and the upper portion 48*a*. The further reduced annulus 74 has a reduced cross sectional flow area to increase the speed of the fluid flowing up and around the junk basket 40. In one aspect, an upper edge 49 of the junk basket 40 is tapered or sloped to pull and direct the fluid toward the central mandrel 18 and under the baffle 50. Thus, the debris in the fluid may be deflected so that it may be diverted into the opening 41. A bottom end 43 of the junk basket 40 may also be tapered to direct fluid around the junk basket 40.

In one configuration, the OD of the junk basket 40 may be the same along its length.

The wellbore cleaning operation may entail additional cleaning tools for liberating debris within the wellbore 12 such as may be accumulated along the interior surface 14. For example, a brush or scraper type tool may be positioned along the upper string, and/or a hydraulically powered jetting or circulating tool positioned below the junk basket device 10. Although tools may be positioned below the junk basket device 10, the junk basket device 10 is typically at the lower end of the string. The lower end 26 of the central mandrel 18 may have a pin type threaded connector 54 for connecting with any tools below the junk basket device 10. The connector 54 is a 6⅝ connection in this embodiment, but may be other sizes.

During the wellbore cleaning operation, the cleaning tools may be used to liberate debris prior to and/or concurrently with passing fluid through the central mandrel 18 of the junk basket device 10, then upward through the annulus past the junk basket device 10. Fluid is thus passed from the upper tubing string X1, downward through the throughbore 22, and through the exit port 24 into the wellbore 12. Fluid passing into the wellbore 12 may gather and carry formation debris present within the wellbore 12. The fluid passes from the wellbore 12 upward through the reduced annulus 74, possibly carrying with it debris from the wellbore 12.

Figure 2:
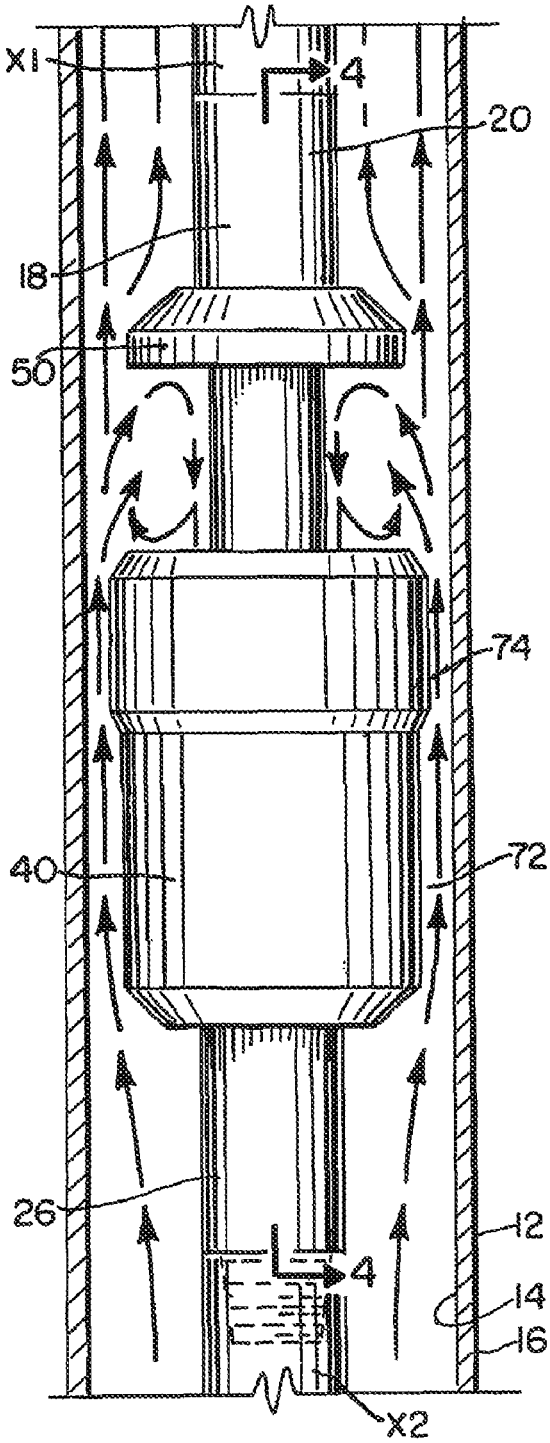
FIG. 2 illustrates a view of the modular junk basket device of FIG. 3 installed in a wellbore.
Figure 3:
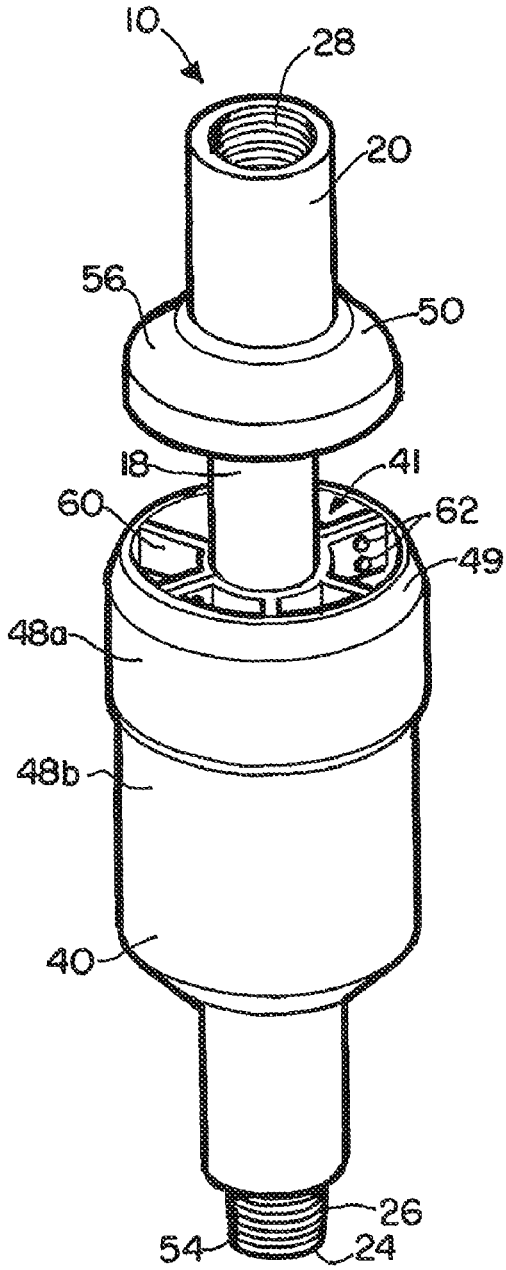
FIG. 3 illustrates a perspective view of a modular junk basket device in accordance with the present invention.
Figure 4:
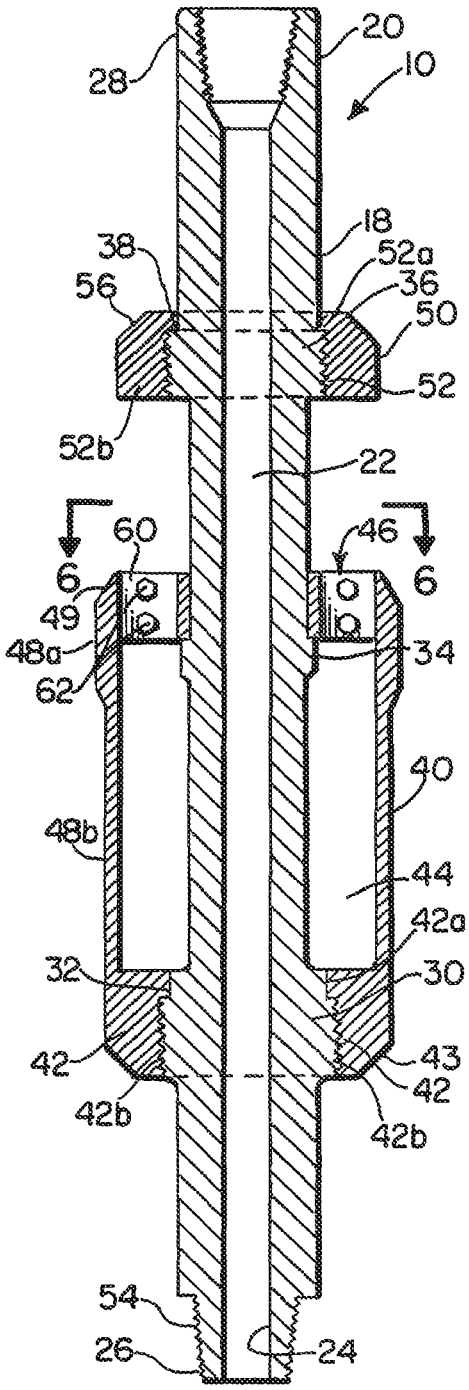
FIG. 4 illustrates a cross sectional view along the plane 4-4 of the modular junk basket device according to the present invention.
Figure 5:
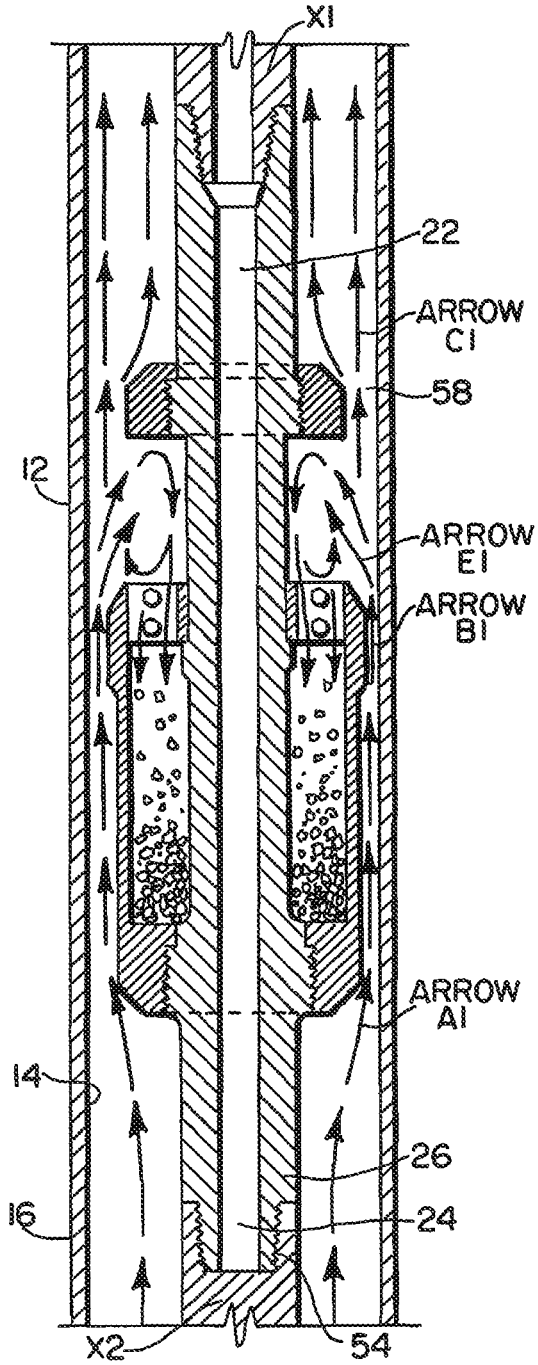
FIG. 5 illustrates the cross section view of the modular junk basket device in FIG. 4 installed in a wellbore.

FIGS. 2 and 5 illustrate the junk basket device 10 installed in a wellbore. The annulus between the wellbore 12 and the junk basket 40 narrows. Thus, the upward-flowing fluid, denoted by ARROW A1, has a first speed. The fluid, denoted by ARROW B1, has a second speed faster than the first speed as it is impeded in the narrow or reduced annulus 74. The fluid, denoted by ARROW C1, continues upward toward the top of the wellbore 12 and is generally slower than the fluid denoted by ARROW B1. However, as the fluid, denoted by ARROW B1, passes the upper edge 49 of the junk basket 40, a portion of the fluid, denoted by ARROW E1, is directed automatically toward the central mandrel 18 as the annulus is enlarged. This portion of the fluid flowing, denoted by ARROW E1, and any debris therein, hit or engage an underside of the baffle 50 in 360°. However, simultaneously, fluid flowing upward in the direction of ARROW C1 flows around the OD of the baffle 50 through reduced annulus 58.

While not wishing to be bound by theory, the obstruction of the baffle 50 creates large eddy currents directly over the opening 41 in the junk basket 40 for the deposit of debris. The velocity of the fluid passing the further reduced annulus 74 to the upper edge 49 of the junk basket 40 increases with decreasing cross sectional area, such that fluid passing through the annulus 72 is accelerated as it passes into the further reduced annulus 74. Baffle 50 allows fluid to pass more freely through reduced annulus 58, as compared to the reduced annulus 74, due to the additional cross area between the OD of the baffle 50 and the ID of the interior surface 14 as compared to the reduced annulus 74.

The placement of baffle 50 allows fluid to slow and swirl over the top opening 41 of the junk basket 40. This flow above the annular junk collecting space 44 will help deflect and carry debris into the junk basket 40, while the upward flow through the further reduced annulus 74 will prevent debris from passing downward into the annulus 72. Thus, fluid and debris passing near and above the junk basket 40 will tend to collect in the annular junk collecting space 44.

Debris originating from below the annular junk collecting space 44 may enter the annular junk collecting space 44 after passing through the annulus 74, and from above the junk basket device 10 after being liberated by cleaning tools. While collecting debris in the annular junk collecting space 44, the junk basket device 10 may be moved vertically within the wellbore 12 during the wellbore cleaning operation. This vertical movement may increase the effectiveness of the wellbore cleaning operation by more thoroughly collecting debris along the wellbore 12.

Upon completion of the wellbore cleaning operation, the upper tubing sting X1 may be moved upward to remove the junk basket device 10 from the wellbore 12.

FIG. 7 illustrates an alternate configuration of the modular junk basket device 100 with a portion of the junk basket 140 and baffle 150 removed. The junk basket 140 in this configuration includes plugs 160 (only one shown) which may be removed from the drain holes 162 to drain fluid from the annulus junk collecting space 144 after the junk basket device 100 is retrieved to the surface. The junk basket device 100 may then be emptied into an appropriate waste receptacle and used again in a subsequent wellbore cleaning operation. As previously described, the baffle 150 may include slots 155 for attaching a tool (not shown) to the baffle 150 so that it can be turned, rotated and tightened about the central mandrel 18.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

PARTS LIST

| | |
|---|---|
| 10 | modular junk basket device |
| 12 | wellbore |
| 14 | interior surface |
| 16 | casing string |
| 18 | central mandrel |
| 20 | upper end |
| 22 | throughbore |
| 24 | exit port |
| 26 | lower end |
| 28 | box type threaded connector |
| 30 | first mandrel coupler |
| 32 | lower edge or seat |
| 34 | upper seat |
| 36 | second mandrel coupler |
| 38 | upper baffle seat |
| 40 | removable junk basket |
| 41 | opening |
| 42 | basket coupler |
| 42a | upper brim |
| 42b | threaded connection section |
| 43 | bottom end |
| 44 | generally annular junk collecting space |
| 46 | top end |
| 48a | upper portion |
| 48b | lower portion |
| 49 | upper edge |
| 50 | removable baffle |
| 52 | baffle coupler |
| 52a | upper baffle brim |
| 52b | threaded connection section |
| 54 | pin type threaded connector |
| 56 | sloped shoulder |
| 58 | reduced annulus |
| 60 | webs |
| 62 | fasteners |
| 64 | spokes |
| 72 | reduced annulus |
| 74 | further reduced annulus |
| 100 | junk basket device |
| 140 | junk basket |
| 144 | generally annular junk collecting space |
| 150 | baffle |
| 155 | slots |
| 160 | plugs |
| 162 | drain holes |
| X1 | upper tubing string |
| X2 | lower tubing string |

What is claimed is:

1. A modular junk basket device comprising:

a junk basket operable to collect debris from a wellbore;

a baffle operable to deflect fluid and debris flowing around the junk basket; and a central mandrel having a top end, a bottom end, a first mandrel coupler operable to removably couple the junk basket concentrically around the central mandrel a distance above the bottom end, and a second mandrel coupler operable to removably couple the baffle a predetermined distance above a top opening in the junk basket and below the top end wherein a top edge of the junk basket is sloped to direct fluid and debris under the baffle.

2. The device according to claim 1, wherein the first mandrel coupler and the second mandrel coupler include threaded connections, the first mandrel coupler being operable to have screwed thereto the junk basket and the second mandrel coupler being operable to have screwed thereto the baffle.

3. The device according to claim 1, wherein:

the first mandrel coupler includes a threaded connection section and a seat above the threaded connection section; and the second mandrel coupler includes a threaded connection section and a seat above the threaded connection section.

4. The device according to claim 3, wherein:

an outer diameter of the first mandrel coupler is larger than the central mandrel; and an outer diameter of the second mandrel coupler is larger than the central mandrel.

5. The device according to claim 4, wherein:

the junk basket includes a basket coupler with a brim operable to be seated on the seat of the first mandrel coupler when the basket coupler and the first mandrel coupler are threaded together; and the baffle includes a baffle coupler with a brim operable to be seated on the seat of the second mandrel coupler when the baffle coupler and the second mandrel coupler are threaded together.

6. The device according to claim 1, wherein a top edge of the baffle is sloped.

7. The device according to claim 1, further comprising: one or more webs between the central mandrel and a top end of the junk basket, the one or more webs being operable to radially space and support the junk basket with respect to the central mandrel.

8. A modular junk basket device comprising:

means for collecting debris from a wellbore;

means for deflecting fluid and debris flowing around the junk basket; and means for communicating the fluid longitudinally therethrough having a top end, a bottom end, first means for removably coupling the debris collecting means concentrically around the communicating means a distance above the bottom end, and second means for removably coupling the deflecting means a predetermined distance above a top opening in the debris collecting means and below the top end wherein a top edge of the debris collecting means is sloped to direct fluid and debris under the deflecting means.

9. The device according to claim 8, wherein:

the first coupling means includes means for screwing the debris collecting means to the fluid communicating means; and the second coupling means includes means for screwing the deflecting means to the fluid communicating means.

10. The device according to claim 9, wherein:

the first coupling means has an outer diameter larger than the fluid communicating means and has a debris collecting means seat; and the second coupling means has an outer diameter larger than the fluid communicating means and has a deflecting means seat.

11. The device according to claim 10, wherein:

the debris collecting means includes a brim operable to be seated on the deflecting means seat of the first coupling means; and the deflecting means includes a brim operable to be seated on the deflecting means seat of the second coupling means.

12. The device according to claim 8, wherein a top edge of the deflecting means is sloped.

13. The device according to claim 8, further comprising: means for radially supporting and spacing a top end of the debris collecting means with respect to the fluid communicating means.

14. A modular junk basket device comprising:

a central mandrel constructed as a single unitary structure having a top end, a bottom end, a first mandrel coupler positioned above the bottom end and a second mandrel coupler positioned below the top end;

a junk basket having a top opening and being removably coupled to the first mandrel coupler and concentrically around the central mandrel a distance above the bottom end, the junk basket being operable to collect debris from a wellbore in through the top opening positioned below the second mandrel coupler;

a baffle operable to deflect fluid and debris flowing up, around and along side of the junk basket and being removably coupled to the second mandrel coupler a predetermined distance above the top opening in the junk basket and below the top end wherein a top edge of the junk basket is sloped to direct fluid and debris under the baffle.

15. The device according to claim 14, wherein the first mandrel coupler and the second mandrel coupler include threaded connections, the first mandrel coupler being operable to have screwed thereto the junk basket and the second mandrel coupler being operable to have screwed thereto the baffle.

16. The device according to claim 14, wherein:

the first mandrel coupler includes a threaded connection section and a seat above the threaded connection section; and the second mandrel coupler includes a threaded connection section and a seat above the threaded connection section.

17. The device according to claim 16, wherein:

the junk basket includes a basket coupler with a brim operable to be seated on the seat of the first mandrel coupler when the basket coupler and the first mandrel coupler are threaded together; and the baffle includes a baffle coupler with a brim operable to be seated on the seat of the second mandrel coupler when the baffle coupler and the second mandrel coupler are threaded together.

18. The device according to claim 14, wherein:

the junk basket further includes one or more webs in proximity to the top opening; and the central mandrel further includes an upper seat configured to rest thereon the one or more webs of the junk basket, the upper seat being between the first mandrel coupler and the second mandrel coupler.

* * * * *